United States Patent [19]

Denman

[11] Patent Number: 4,804,144

[45] Date of Patent: Feb. 14, 1989

[54] APPARATUS FOR DISPENSING VISCOUS MATERIALS

[75] Inventor: Stephen A. Denman, Centerville, Ohio

[73] Assignee: Tekex Company, Dayton, Ohio

[21] Appl. No.: 303,777

[22] Filed: Sep. 21, 1981

[51] Int. Cl.[4] ..... B05B 7/30

[52] U.S. Cl. ..... 239/346; 222/630; 239/369; 239/371; 239/390; 239/600; 248/312

[58] Field of Search ..... 248/312; 222/630; 239/310, 314, 318, 337, 340, 346, 369, 371, 390, 397, 424, 423, 600

[56] References Cited

U.S. PATENT DOCUMENTS

| | | | |
|---|---|---|---|
| 1,022,206 | 4/1912 | Quest | 239/346 |
| 1,787,583 | 1/1931 | Larson | 239/371 X |
| 1,853,808 | 4/1932 | Greenwood | 248/312 X |
| 2,106,627 | 1/1938 | Brennan | 239/340 |
| 2,754,009 | 7/1956 | Kennedy | 248/312 X |
| 2,951,590 | 9/1960 | Fesser | 248/312 X |
| 3,908,948 | 9/1975 | Hawthorne | 248/312 X |

*Primary Examiner*—Andres Kashnikow

*Attorney, Agent, or Firm*—Jerome P. Bloom

[57] ABSTRACT

A pneumatic, syphon type apparatus particularly advantageous for dispensing and applying viscous materials in a spray form features, in a preferred embodiment, a throwaway eductor assembly which slip fits to the delivery end of a tubular structure adapted for connection to and delivery therethrough of air or other gaseous fluid under pressure. The eductor assembly comprises a tubular adapter extended at one end by an eductor tube and at the other by an applied nozzle and a syphon tube connected therewith to open to its interior adjacent the nozzle and at right angles thereto. In use of the apparatus the syphon tube is introduced to a body of the material to be dispensed as the end of the adapter including the nozzle is releasably coupled to the discharge end of the tube which is connected to a source of air under pressure. In preferred embodiments the tubular structure for delivering air, under pressure, to and through the nozzle of the eductor assembly mounts apparatus for the quick releasable coupling thereto of the container of a quantity of the material to be dispensed and applied by way of the eductor assembly in a spray form. The apparatus enables a quick substitution of one eductor assembly for another and one container of material for another.

8 Claims, 2 Drawing Sheets

APPARATUS FOR DISPENSING VISCOUS MATERIALS

BACKGROUND OF THE INVENTION

This invention relates to new and improved pneumatic, syphon type, apparatus capable of effectively dispensing liquid material in a spray form and in a manner so controlled as to facilitate a substantially uniform coating of a surface with the material sprayed. Embodiments feature a disposable, readily interchangeable, eductor assembly which renders them economical to fabricate, more efficient and satisfactory in use, more versatile in application and unlikely to malfunction.

Embodiments of the invention are particularly advantageous for use in the dispensing of viscous materials in a spray form and they will be so described, but only for purpose of illustration and not by way of limitation.

Spray type applicators of the prior art used to produce a surface coating have left much to be desired as to their performance, particularly when the material to be applied has a relatively heavy viscous character. It seems that after a short period of their use in dispensing a viscous material, they are often unable to produce and maintain the initial uniformity of their discharge. At this point one option (often selected) has been to continue their use, in which event the quality of the sprayed coating which results is poor. Another option has been to interrupt the procedure and check the dispenser, in which event it is usually found the discharge passage of the dispenser has been restricted or partially plugged by the material being dispensed adhering in part to the wall of the discharge passage. In either case these are unsatisfactory results. In the one case there is inefficiency and poor performance in producing an end product which leaves much to be desired. In the other case there is a waste of time, material and money. In any case the prior art spray type dispenser must be cleaned frequently, a very messy and time consuming procedure. The design of the prior art apparatus of the category with which we are here concerned moreover, is usually such that it is virtually impossible to insure a thorough and total cleaning of the apparatus. This last can result in a contamination of the material subsequently dispensed by the same apparatus. Problems such as this are solved by the apparatus of the present invention.

Not only does the present invention solve the aforementioned problems but it also provides for the creation of a compact easily handled package of the dispenser apparatus of the invention in connection with a container of the material to be dispensed. By virtue of the invention both the eductor assembly of the dispenser and the container of material of the package may be readily and quickly interchanged should the user wish to change the nature of the material being dispensed.

As far as the inventor or anyone else involved in the substantive preparation of this disclosure is aware, there is no prior art which exhibits the specific features of the invention the novelty of which is herein claimed.

SUMMARY OF THE INVENTION

Invention embodiments feature a "throwaway" eductor assembly which may be releasably slip or press fit in the delivery end of a tube connected to a source of gaseous fluid, which in most cases will be air, under pressure. This eductor assembly comprises a tubular adapter extended at one end by an eductor tube portion and at its opposite end by an applied nozzle and having in communication with its interior, adjacent the nozzle and at right angles thereto, a syphon tube portion. The syphon tube portion is introduced, in use, to a body of the material to be dispensed while the end of the adapter including the nozzle is applied to the discharge end of the tube connected to a source of gaseous fluid under pressure. The tube for the delivery of gaseous fluid will be conventionally provided with a valve which is in normally closing relation to its fluid delivery passage and adapted to be readily opened as and when a discharge of the fluid under pressure is required.

In accordance with the invention, the eductor assembly is secured to form an extension of the tube for delivery of gaseous fluid under pressure by a simple quick release retention means. Furthermore, the fluid delivery tube is modified to embody means for a ready coupling thereof to a container of material to be dispensed by way of the eductor assembly, which coupling can be quickly and easily disengaged from the container. The construction is such to enable both the eductor assembly and the container of the material to be dispensed or either one of the same to be interchanged or replaced in a matter of seconds.

According to the invention the eductor assembly is preferably formed of plastic material and it is in any case so economical to fabricate and provide, as well as to apply, that it provides a pneumatic, syphon type spray apparatus for dispensing materials, even relatively heavy viscous materials, in spray form which is more economical to fabricate, more efficient and satisfactory in use, highly versatile and adaptable for use in numerous applications and unlikely to cause any significant problem in its use.

Another object of the invention is to provide improvements in pneumatic syphon type apparatus for facilitating the application of a relatively uniform coating of a surface in the best possible form and in the least possible time.

Another object of the invention is to provide a pneumatic syphon type spray gun capable of dispensing fluid materials, even relatively heavy viscous fluid materials, featuring a readily disposable and interchangeable eductor assembly facilitating the application of the apparatus to the dispensing of different materials in immediate succession without significant loss of time and without concern for the contamination of materials subsequently dispensed by materials previously dispensed.

An additional object is to provide a disposable eductor assembly which can be readily applied to form an extension of a tubular device connected to a source of gaseous fluid under pressure. It is a further object to provide simple and effective means for a quick release coupling of the eductor assembly to form an extension of the discharge end of the tubular device connected to a source of gaseous fluid under pressure. It is another object to provide a tubular device for the delivery of gaseous fluid under pressure with means for the quick releasable coupling thereto of an eductor assembly in accordance with the invention as well as means for the quick coupling thereto of a container of materials to be dispensed by way of said eductor assembly.

A further object of the invention is to provide a pneumatic syphon type spray gun and a disposable eductor assembly for application thereto possessing the advantageous structural features, the inherent meritorious characteristics and the means and mode of use herein described.

With the above and other incidental objects in view as will more fully appear in the specification, the invention intended to be protected by Letters Patent consists of the features of construction, the parts and combinations thereof, and the mode of operation as hereinafter described or illustrated in the accompanying drawings, or their equivalents.

Referring to the drawings wherein are shown some but not the only forms of embodiment of the invention, FIG. 1 is a side elevation view of one embodiment of the invention, shown partly in section;

FIG. 2 is a view taken on line 2—2 of FIG. 1;

FIG. 2*a* is a view taken in line 2*a*—2*a* of FIG. 1;

Like parts are indicated by similar characters of reference throughout the several views.

Figures 1, 2, 2A, 3, 4, 5:
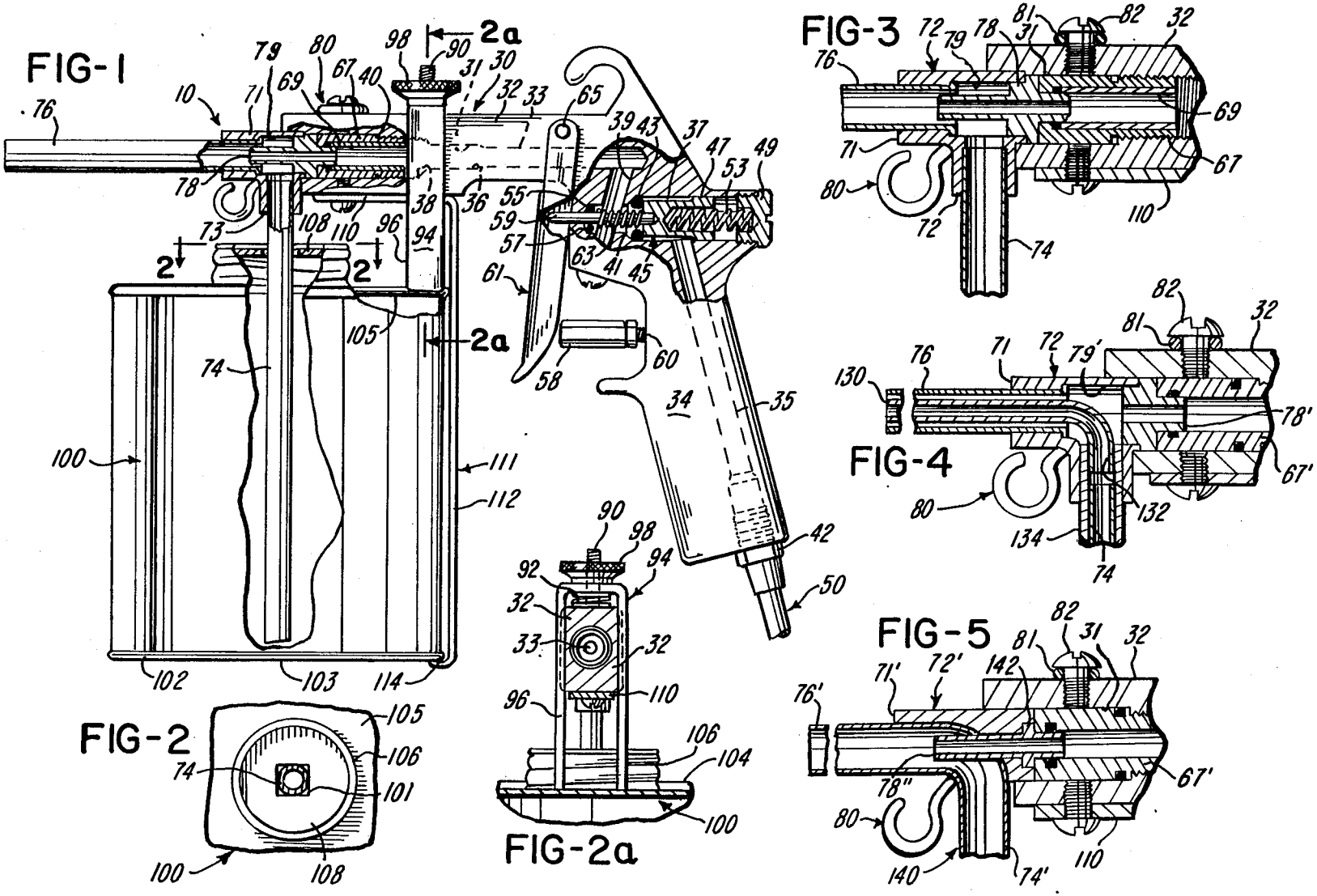
FIG. 3 is an enlarged view of a fragment of FIG. 1.
FIGS. 4 and 5 illustrate, in longitudinal section, modifications of the form of the eductor assembly illustrated as part of the apparatus of FIGS. 1 and 3.
Figure 9:
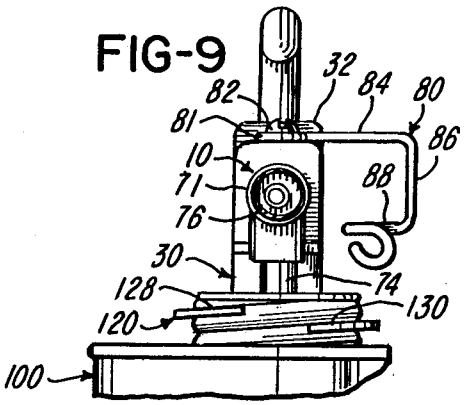
FIG. 9 is a view taken on line 9—9 of FIG. 6 showing the device for coupling the eductor assembly thereof in both a coupling and an uncoupling position.

In FIG. 1 of the drawings, an eductor assembly 10 per the present invention is shown as slip fit to form an extension of one end of a tube structure 30, the opposite end of which is coupled to a line 50 connected to a suitable source of air under pressure. In this embodiment the tube structure 30 is bent intermediate its ends to provide it with the shape of a small hand gun and to comprise, accordingly, a barrel portion 32 and a grip portion 34. The grip portion forms a slightly obtuse angle with the barrel portion, one which preferably does not exceed 120° and what may be considered its inner and outer edges are flat. In addition to this, the sides of this gun shaped tube structure are flat, parallel and relatively closely spaced.

The bore 33 of the tube structure is continuous, opening at one end from the discharge end of the barrel portion where it is gradually enlarged by a stepped configuration of its bounding wall surface 31. The stepping of the wall surface 31 produces therein three successive, longitudinally spaced, annular shoulders 36, 38, 40 all of which face outwardly of the discharge end of the barrel portion, the shoulder 36 being innermost and the shoulder 40 outermost. The bore of the barrel portion is continued, somewhat deviously, through the grip portion to have its inlet end open from the grip base. The inlet end of the bore is counterbored and the wall surface bounding this counterbore is threaded so it may be threadedly engaged by a tubular adapter 42 connected with and forming an extension of the delivery end of the line 50.

The portion of the bore 33 in the grip 34 is comprised of three sections. The first of these sections, identified in the drawings as 35, extends upwardly from the grip base in a straight line which is closely adjacent and substantially parallel to the outer edge of the grip. The extremity of the section 35 remote from the grip base opens to a section 37 of the bore which is transverse to the grip portion 34, as seen in side elevation, and in a line parallel to and spaced from that portion of the bore which is defined within the barrel 32.

As originally formed, the section 37 extends between and through the inner and outer edges of the grip. The wall which defines the section 37 is stepped and its largest diameter portion, formed by a counterbore, extends more than one half its length from the outer towards the inner edge of the grip to terminate in an annular shoulder 41. The annular shoulder 41 faces outwardly in the direction of the outer edge of the grip. The shoulder 41 seats an O-ring 43 to which is abutted the base of a cup shaped valve element 45 the outer diameter of which is less than the diameter of the counterbored portion of the section 37. However, the mouth of the cup shaped valve member 45 has an external annular flange 47 the outer peripheral edge of which bears on the wall of the counterbore in which it is located, beyond the opening thereto of the section 35. The end of the section 37 which opens from the outer edge of the grip is plugged by a threadedly engaged cap 49. The innermost end of cap 49 has a cup shape nesting one end portion of a coil spring 53 the other end of which projects within and seats to the inner surface of the base of the cup shaped valve element 45. As long as the cap 49 is applied, the spring 53 will be compressed and bias valve element 45 to press the O-ring 43 against the shoulder 41 thereby to normally seal the bore of the tube structure 30 intermediate the section 35 thereof in the grip and the following section 39 which opens to the section of the bore 33 in the barrel portion 32.

In the direction of the inner edge of the grip 34 following the shoulder 41 the section 37 has a short section of its length of uniform diameter corresponding in dimension to that of the diameter of the opening defined by the inner peripheral edge of the shoulder 41, following which its diameter is further reduced to define therein a shoulder 55. The shoulder 55 faces in the same direction as shoulder 41 and is in a plane parallel thereto.

The shoulder 55 seats an O-ring 57. A control pin 59 has one end suitably anchored in the base of the valve element 45 so it projects therefrom, coaxially therewith, to extend through and in bearing relation to the O-ring 57. Beyond the O-ring 57 the pin 59 projects outwardly of the inner edge of the grip and into the channel of a channel shaped trigger element 61.

The control pin 59 is encircled by a coil spring 63. One end of the spring 53 abuts the base of the valve element 45 and the other the O-ring 57. The bias of the spring 63 on the valve 45 so provided is less than that of spring 53. However, the bias of spring 53 on the O-ring 57 is sufficient to cause this O-ring to seal against the shoulder 55 and about the control pin.

The bore section 39 opens to the section 37 at a location intermediate the shoulders 41 and 55.

As seen in FIG. 1, the trigger 61 has the sides of its channel form extended upwardly to embrace and be connected to opposite sides of the barrel portion 32 by coaxially aligned pivot pins 65. The upper end of the bridging portion of the channel form of the trigger positions immediately under and in closely spaced relation to the underside of the barrel portion adjacent the grip. This limits the pivotal movement of the trigger outwardly of the grip in a manner believed obvious. Its pivotal movement towards the adjacent inner edge portion of the grip is limited by the outer end of a tubular sleeve 58 adjustably and threadedly engaged to the outer end of an externally threaded pin 60 the inner end of which is anchored in the inner edge of the grip portion 34. The sleeve 58 is positioned in the path of the trigger towards its lowermost end.

It will be seen that, on applying a hand to the grip portion 34 and squeezing the trigger 61, the base or bridging portion of the inner wall surface of the channel shaped trigger will press inwardly on the pin 59 and the valve 45, against the bias of the spring 53. This displaces the valve element 45 from the O-ring 43 and opens a path for flow of air from the section 35 to the section 39 and the following section of bore 33 in the barrel portion 32.

The wall portion of the bore 33 between the shoulders 38 and 40 is threadedly engaged by the inner end of a sleeve-like insert 67. The insert 67 extends outwardly of shoulder 40 in the direction of and terminates short of the outer end of the barrel. The sleeve 67 lines that portion of the bore in which it is located. The outermost end of the sleeve 67 has a narrow annular, internal, flange seating at its inner surface an O-ring to which is abutted one end of a second sleeve 69 which lines the sleeve 67. The inner surface of the flange on the sleeve 67 is directly and coaxially extended by the inner peripheral surface of the sleeve 69.

Figure 12:
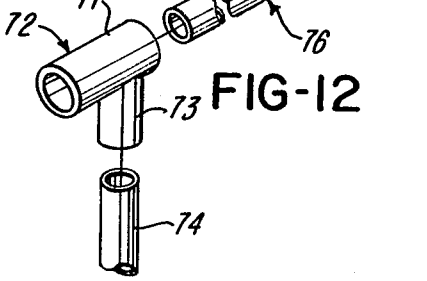
FIG. 12 is an exploded perspective view of the first eductor assembly of the invention herein illustrated.
Figure 8:
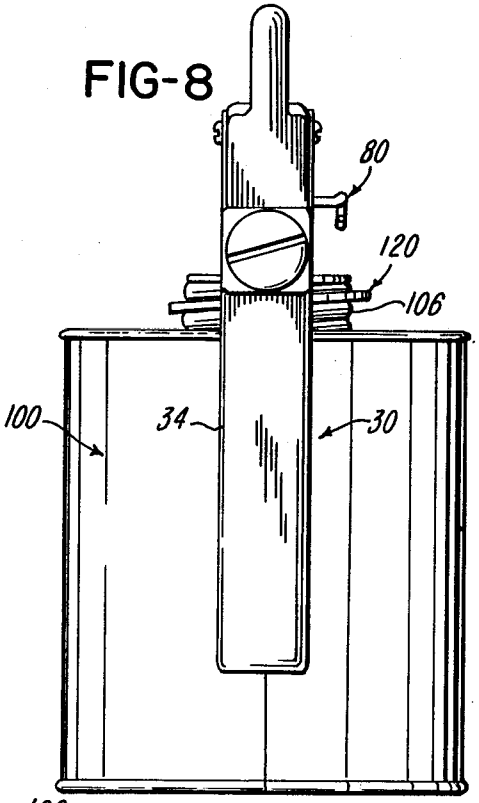
FIG. 8 illustrates a rear view of the apparatus of FIG. 1 embodying the modification of FIG. 6.
Figure 10:
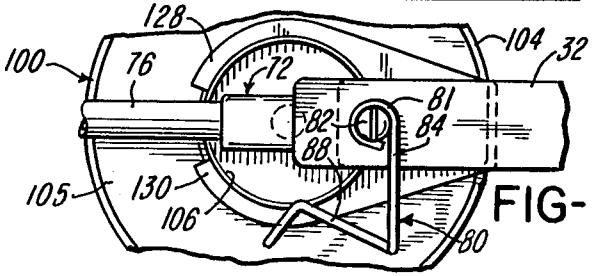
FIG. 10 is a view taken on line 10—10 of FIG. 6.
Figure 7:
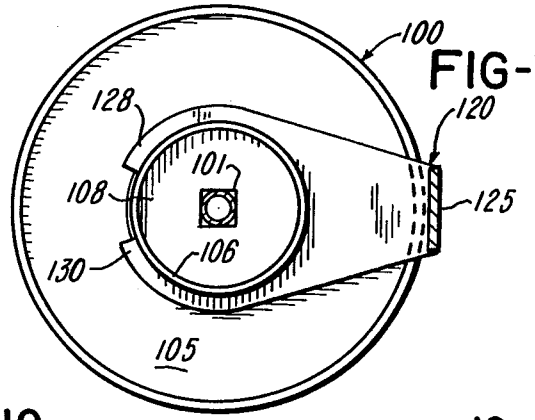
FIG. 7 is a view taken on line 7—7 of FIG. 6.
Figure 6:
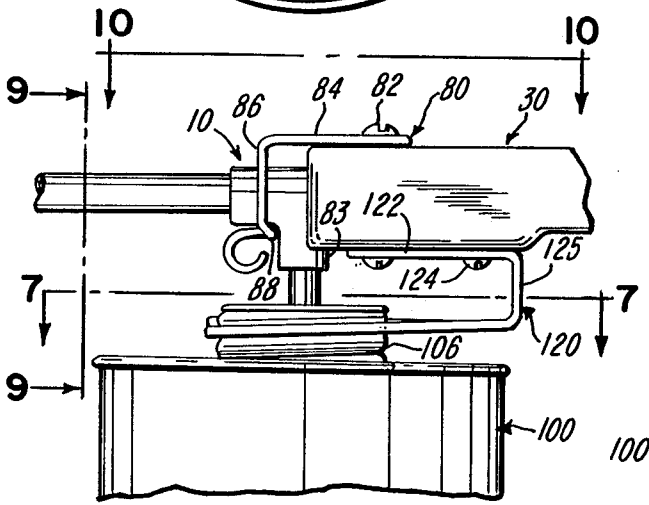
FIG. 6 is the view of a fragment of the apparatus of FIG. 1 illustrating a modification of the device shown therein for coupling the illustrated dispenser apparatus to a container of the material to be dispensed.

The eductor assembly 10 shown in FIGS. 1 and 12 is a disposable device formed of plastic tubing. It is so inexpensive to fabricate that it is a "throw-away" unit, comprising an adapter 72, an elongate small bore syphon tube 74, an elongate eductor tube 76, the bore of which is somewhat larger than that of the syphon tube 74, and a nozzle 78.

The adapter 72 is a thin walled composite structure comprising a first tube 71 of straight line configuration which is short in length. The tube 71 has a single radial opening in its wall structure which is rimmed at its outer surface by an integral radially and outwardly projected tube 73. Tube 73 is shorter and its internal diameter is less than that of the tube 71. The internal diameter of tube 73 is slightly expanded from a location immediately outward of its connection to the tube 71. The radial opening rimmed by the tube 73 is located closely adjacent but spaced from one end of the tube 71 in which is press fit the nozzle 78. The internal diameter of the tube 71 is uniform from the end thereof receiving the nozzle 78 to a point beyond the location of the radial opening in its wall structure where it is slightly reduced to form a shoulder in the inner wall surface of the tube.

As seen from the drawings, the eductor tube 76, being formed of plastic tubing, has a substantially smooth interior wall surface and a substantially uniform bore the length thereof. Furthermore the tube 76 has an external flange at one end and is otherwise uniform as to its external diameter, which is designed to closely fit with that portion of the inner wall surface of the tube 71 which exhibits its minimum diameter. The eductor tube is assembled to the adapter 72 prior to the application of the nozzle 78. To this end its end remote from its flanged end is first inserted through the end of the tube 71 which is closely adjacent the radial opening in its wall structure, following which it is advanced through and outwardly of the tube until the flange thereon abuts the shoulder formed in the inner wall surface of the tube 71. A suitable adhesive is applied to insure a bonding between the tube 76 and the tube 71 to establish a fixed relation thereof, in a manner believed obvious. As so applied the eductor tube 76 forms a coaxial extension of the tube 71.

The nozzle 78 comprises a tubular body of straight line configuration having a small bore the length thereof and a thin wall the major portion of its length. As the drawings illustrate, the diameter of the nozzle bore is essentially uniform. At one location intermediate its ends, closely adjacent but spaced from what might be considered its inlet end, a short section of the length of the wall of the tubular body constituting the nozzle is substantially thickened in a stepped fashion to provide its outer surface with two portions of different diameter, the diameter of each of which is greater than that of the nozzle body to either end thereof. A short portion of the length of this thickened wall portion of the nozzle body most adjacent its inlet end exhibits its maximum diameter, the size of which is complementary to that of the bore 33 at the outermost end of the barrel portion 32. The remainder of the length of this thickened wall portion of the nozzle body is reduced in diameter sufficiently to enable it to closely fit the end of the tube 71 most adjacent the radial opening in its wall structure. The stepping of the diameter of the thickened wall portion provides, in effect, a flange at one end thereof offering a shoulder surface abutting that end of the tube 71 to which the nozzle is applied as the remainder of the length of the thickened wall portion fits in frictional engagement with the inner wall of the tube 71. The thickened wall portion of the nozzle body thus provides an adapter for the press fit coupling of the nozzle to the tube 71 the outermost portion of which is dimensioned to form an extension of the tube wall. As the nozzle is applied, the innermost end of its thickened wall portion extends to the adjacent edge portion of the radial opening in the wall of tube 71. At the same time the inwardly positioned thin walled portion of the nozzle projects in concentric spaced relation to the tube 71 and the innermost end of the eductor tube 76, passing over and in a spaced relation to the radial opening to the tube 73.

One end of the elongate syphon tube 74 is press fit in the outer end of the tube 73 and inwardly thereof to a point just short of the radial opening in the wall of tube 71. As thus applied the syphon tube 74 defines a coaxial extension of the tube 73.

A suitable adhesive is applied to fix the syphon tube 74 and the nozzle 78 to those portions of the adapter 72 to which they apply.

It is believed quite obvious that the parts of the eductor assembly 10 are simple to fabricate and easy to assemble. The resulting integrated structure is not only economical as to its cost but simple to apply. In preparation for its use one need only immerse one end of the syphon tube 74 in the contents of a container to be dispensed and establish a slip fit coupling of the eductor assembly to the discharge end of the barrel portion 32. This provides that the bores of the nozzle 78 and the eductor 76 form coaxial extensions of the bore 33. It may be seen in FIG. 1 that in the slip fit application of the eductor assembly the inlet end of the nozzle 78 projects through the opening defined by the inner peripheral edge of the flange at the outermost end of the insert 67, through and in bearing relation to the inner peripheral edge portion of the O-ring held to the flange by the sleeve 69 and into the sleeve 69. In this process the O-ring held to the flange of the insert 67 will form a seal about the inlet end of the nozzle. The radial shoulder produced by the enlargement of the wall thickness of the nozzle adjacent its inlet end abuts the flanged end of the sleeve-like insert 73 to establish the coaxial relation of the bore of the nozzle with the bore 33.

The lowermost portion of the outermost or discharge end of the barrel portion 32 is provided with a notch the shape of which is formed on a radius complementary to that of the tube 73 of the adapter 72. This determines that in the application of the eductor assembly the tube 73 will nest, in part, in this notch to insure that the syphon tube 74 will depend from and in a line perpendicular to the line of the bore 33 and its extensions which are provided by the bores of the nozzle 78, tube 71 and tube 76.

Once the eductor assembly is so positioned with reference to the barrel portion 32, it is releasably held there by the application of a spring clip formed of a short length of wire 80. Attention is particularly directed to FIGS. 1, 8, 9 and 10 of the drawings for its detail. As there seen, one end 81 of the wire 80 is looped and pivotally mounted about the body of a screw 82 anchored in and projected perpendicular to the top or upper edge of the barrel portion 32, adjacent its outer end and centered between its sides. The enlarged head portion of the screw serves to contain the looped end of the wire 80 and control the path of movement of the spring clip to and from a position in which it releasably secures the eductor assembly to the discharge end of barrel portion 32. The looped extremity 81 is formed as a continuation of a short straight line portion 84 of the wire 80 which projects from and tangential to the unthreaded body portion of screw 82 on which the wire pivots. In a pivoting movement of the clip the portion 84 moves in a plane parallel to and immediately of the uppermost surface of the barrel portion 32. The portion 84 is continued by a straight line portion 86 which depends at a right angle to and co-planar with the portion 84. The lowermost end of the portion 86 of the wire clip is connected integral with and continued by a short portion 88 thereof which is oriented to lie in a plane below and generally parallel to that plane in which the portion 84 of the clip moves in use thereof. The portion 88 is bent inwardly towards and projects at an acute angle to the plane of the portions 84 and 86. The extremity of the clip 80 outermost from its pivoted end is bent outwardly from and substantially at right angles to the wire portion 88, and looped on itself to facilitate the grasping thereof between the thumb and forefinger of a hand. The disposition and angular relation of the different portions of the clip and the nature of its mount enable its easy movement to and from a position wherein the portions 86 and 88 of the clip wrap over and immediately under the adapter 72 at the outermost portion of the joint between the tube 71 and the tube 73 as the eductor assembly is applied to form an extension of the barrel portion 32. The shape of the clip is such to securely hold the complete eductor assembly in a fixed relation to the outer end of the barrel portion 32 during the required function of the assembly so provided.

FIGS. 1 and 2*a* of the drawings, illustrate a screw formed stud 90 immediately to the rear of the pivot 82 which is anchored in and projected perpendicular to the upper edge of the barrel portion 32 at a location centered between its sides. Positioned about the stud 90 is a coil spring 92. Above the spring 92 the stud 90 is projected through an aperture centered in the base of an inverted, rectangularly configured, U-shaped member 94 the side or leg portions 96 of which depend to extend through rectangular vertical grooves in the opposite sides of the barrel portion, the side walls of which grooves fix the positions of the legs as they project below the barrel portion. The U-shaped member 94 thus bridges and straddles and is biased somewhat upwardly from the top of the barrel portion by the spring 92. A nut 98 applied to the outermost or upper end of the stud 90, in threaded engagement therewith, serves to establish a limit to an upward movement of the member 94 or to fix its bridging portion to the top of the barrel portion as needs require.

Referring once more to FIG. 1, a container 100 the contents of which may be a viscous liquid, if the same is required to be dispensed through the eductor assembly 10, has a generally cylindrical configuration, a projected bead 102 peripheral to its bottom surface 103 and a similarly projected bead 104 peripheral to its upper surface 105. A the center of the upper surface 105 is an opening rimmed by a generally short tubular projection 106 the outer peripheral surface of which is formed so as to be threaded for application thereto and closure thereof by a cap (not shown). The upper or outermost end of this threaded tubular projection is normally bridged and sealed by a disc 108 the center portion of which is bounded by a rectangular scoring which weakens the disc in the line thereof.

The rectangular center portion of the seal defined by the scoring will be punched out to afford an opening 101 for passage of the syphon tube into the container 100. As seen in FIG. 2, the peripheral edge bounding the opening 101 will be dimensioned to closely bound the tube 74 so as to leave small openings at its corners for communication of the air of the environment with the upper surface of the contents of the container. The tube 74 will normally have a length such that its lower end, cut at an angle, will depend to a level closely adjacent the bottom of the container.

The short leg 110 of an L-shaped strap element 111 is fixed, by screws, to the flatted bottom surface portion of the discharge end of the barrel portion 32 to have the longer leg 112 of the strap depend therefrom and perpendicular thereto. As the eductor assembly is coupled to the gun-shaped air delivery tube 30, the leg 112 will position in a line substantially parallel to that of the tube 74. The lowermost or projected end of leg 112 is curved to provide it with the form of a shallow hook 114. In use the hook 114 will be engaged under a portion of the bead 102 at the bottom of the container 100. As this support is provided at the bottom of the container, the portion of the top of the container directly above that engaged by hook 114 will be positioned immediately below the dependent extremities of the legs 96 of the member 94. At this point the nut 98 will be turned to force the member 94 down, against the bias of spring 92, to cause the dependent extremities of the legs 96 to seat firmly to the top of the container 100 immediately in line with the hook 114 to clamp the container in a seated relation to the hook. As so fixed, the container 100 is securely and stably mounted in a connected relation to the strap 110, 112 and the gun-shaped delivery tube 30. This assembly and the package so provided is easy to achieve. Obviously, the container can be just as easily and quickly disengaged from its support and cleared of the syphon 74. The eductor assembly 10, if desired, can be disengaged from the gun-shaped delivery tube 30 in an instant, upon swinging the clip 80 from its engaged position to its disengaged position, with reference to the eductor assembly.

It should be obvious from the foregoing that when the contents of one container 100 is evacuated that a second full container can be readily substituted. By the same token, should one wish to use the invention apparatus described to apply a material of a different nature than that previously sprayed, then, at the option of the user, a fresh, clean eductor assembly 10 may be substituted for that previously used and applied in the manner previously described to a fresh container of the new material to be dispensed in a spray form. As has been mentioned previously, the eductor assembly of the invention is so economical to fabricate that it is a disposable or "throw-away" item. An obvious benefit which derives from this advantage is that in applying the new material one is insured of its delivery, in a spray form, through apparatus which is totally uncontaminated by other materials. At the same time it is the option of the user to let the previously used eductor assembly soak in a suitable solvent to loosen and free therefrom any contaminating materials. Subsequently, one can complete the cleaning procedure at his or her lesiure and thereby provide an eductor assembly which is capable of further use without fear of contaminating any material which may be directed therethrough.

Referring more particularly to the operation of the assembly of apparatus shown in FIG. 1, to initiate its function after a line 50 is coupled to the inlet end of the bore 33 of the delivery tube 30, the trigger 61 is squeezed. This action will cause a displacement of the normally closed valving erlement 45. Air under pressure will then move from its source to and through the bore 33 to pass through the assembly of the insert 67 and the liner 69 adjacent the discharge end of the barrel portion 32 and to and through the bore of the nozzle 78. The discharge end of the nozzle 78 projects slightly within the inner end of the eductor tube 76 and defines therewith a narrow annular passage which is peripheral to the discharge end of the nozzle. As the air under pressure moves from the nozzle 78, it will produce a substantial reduction in pressure in the area about its discharge end which is reflected back through the chamber between the inner end of the eductor tube and the adjacent relatively spaced end wall surface of the thickened portion of the nozzle body. The vacuum thus produced in this chamber is extended to and through the syphon tube 74 and applied to the contents of the container 100. As long as this flow of air under the prescribed pressure continues to move outwardly from the discharge end of the nozzle, there will be, accordingly, a resulting suction which will cause contents of the container 100, even when it has a high degree of viscosity, to move rapidly, in a free moving flow, upwardly of and the length of the syphon tube, into the chamber about the nozzle and to and through the annular passage about the nozzle at the inlet end of the eductor tube and outwardly of the eductor tube under the influence of the flowing air. The arrangement and construction described produces the ejection of the material from the container at a high velocity and causes it to move from the discharge end of the eductor tube in a relatively uniform spray pattern which is continuing in nature, as long as the flow of air under pressure is maintained to and through the nozzle and the eductor tube. Tests of the invention apparatus have established that one can deliver viscous material from a container such a uniform spray pattern that one can readily in and quickly achieve a coating of any surface to which the sprayed material is applied which is of optimal quality for its intended use.

FIGS. 6–11 of the drawings are an extension of the previous figures and the only distingushing portion thereof is the substitution of a single strap 120 which can be used as a substitute for both the U-shaped member 94 and the L-shaped strap 110, 112.

Figure 11:
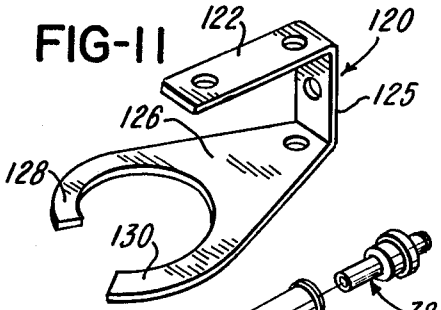
FIG. 11 is a perspective view of the device shown in FIGS. 6, 8 and 9 for coupling the container of viscous material illustrated therein to the dispensing apparatus illustrated.

The strap 120, a perspective of which is shown in FIG. 11, has a substantially U-shape of generally rectangular configuration. In the application of the strap 120 one leg 122 thereof, of rectangular configuration, is secured in flush abutment to the flat underside of the discharge end of the barrel portion 32 by screws 124. With this arrangement the base or bridging portion 125 of the "U" is perpendicular to the line of the bore 33 and the underside of the barrel. The other leg 126 of the strap is inclined outwardly from a parallel relation to the leg 122. The leg 126 is longer than the leg 122, its side edges diverge as they extend from the base 125 and its outer end, which is rounded is bifurcated. The bifurcation of the outer end of leg 126 is so formed to produce arcuately configured fingers 128 and 130 which curve inwardly towards each other but in an offset relation. The fingers are thus relatively displaced and spaced at their adjacent ends and in their composite they create a section of a helix. The construction of the bifurcated end of the leg 126, so provided, is such that it may be threaded on or have threaded therein the tubular projection 106 of the container 100 the outer surface of which has a complimentary thread configuration.

Accordingly, as should be obvious, in use of the invention apparatus of FIG. 1, rather than utilizing the member 94 and associated structure and the L-shaped member 111 to support the container 100, one may fix the strap 120 in connection with the barrel portion 32 of the gun-shaped delivery tube 30 and simply screw a container 100 of material to be dispensed into a stably supported fixed relation to the strap. The use of the strap 120 will not otherwise change the apparatus of FIG. 1, the assembly of its parts or their function.

FIG. 4 of the drawings exhibits a modification of the eductor assembly of FIG. 1. This assembly includes the adapter 72 and eductor tube 76 of FIG. 1 coupled and secured together in the manner previously described. The eductor assembly also includes a nozzle 78' applied in a manner similiar to the nozzle of FIG. 1. The nozzle 78' differs in structure from that of FIG. 1 by reason of an enlargement of its bore and a shortening of its length. The latter difference is achieved by the omission from the nozzle 78' of the thin walled discharge end portion of the nozzle 78 which in FIG. 1 is shown to project inwardly of the tube 71, over and beyond its radial opening.

The eductor assembly of FIG. 4 is further distinguished from that of FIG. 1 as follows. A small bore tube 130 is provided the major portion of the length of which extends the length of the eductor 76 in a concentrically spaced relation to its inner wall surface. At its innermost end the tube 130 is continued inwardly of the chamber 79' defined within the tube 71 between the inner end of the eductor tube and the nozzle 78'. As the tube 130 extends into the chamber 79' it is smoothly curved 90° to provide it with an end portion 132 which is at right angles to that portion which extends through the eductor tube 76. The end portion 132 projects through the radial opening in the tube 71 and into and in a concentric spaced relation to the radially innermost end of the tube 73. The projected extremity of the end portion is press fit in one end of a short sleeve 134 which is press fit inwardly of the tube 73 from its radially outermost ends. One end of a syphon tube 74 is press fit in the opposite end of the sleeve 134 to position its extremity in an adjacent closely spaced relation to the projected extremity of the tube portion 132. By reason of the application of the sleeve 134 the bore of the tube 130 forms a direct extension of the bore of the syphon tube 74.

Attention is directed to the fact that in FIG. 4 of the drawings there is substituted for the insert 67 and the sleeve 69 of FIG. 1 an insert which is an integral composite 67' of the sleeve 69 and the insert 67. This does not in any respect, change the interrelation of the nozzle and the insert in the application of the eductor assembly in the discharge end of the bore in the barrel portion 32.

In the use of the eductor assembly of FIG. 4 as a substitute for that shown in FIG. 1, as air is delivered from the discharge end of the bore 33 by way of the nozzle 78', it will expand as it enters the chamber 79' intermediate to the nozzle and the eductor tube in the adapter 72. The air will then move, at a high velocity, through the annular passage between the tube 130 and the eductor tube and issue from the eductor tube about the discharge end of the tube 130. The discharge ends of the tubes 76 and 130 terminate in substantially the same plane. As the air, under pressure, flows past the discharge end of the tube 130, it produces a pressure drop, resulting in suction the effect of which is transmitted through the tube 130, the sleeve 134 and syphon tube 74 to the contents of the container 100. The net result is that material is drawn from the container and caused to discharge in a spray form in which particles of the material are effectively dispersed. While the apparatus of FIG. 1 is preferred, as far as the eductor assembly is concerned, the substitution of the modification of FIG. 4 will produce results in the use thereof which are highly satisfactory. The same applies to the modification of the eductor assembly shown in FIG. 5.

Each of the modifications of the eductor assembly of FIG. 1 illustrated in FIGS. 4 and 5 is assembled and retained to form an extension of the barrel portion 32 in the same manner as demonstrated by the structure of FIG. 1.

FIG. 5 illustrates an eductor assembly including an adapter 72' consisting of a tube 71'; eductor and syphon tube portions 76' and 74'; and a nozzle 78''. The eductor and syphon tube portions are in this case embodied as part of a single length of tubing 140. The tube 140 is bent intermediate its ends to produce a 90° curved segment therein from one end of which extends the eductor tube portion 76' and from the other end of which extends syphon tube portion 74'.

The nozzle 78'' is a small bore, elongate, thin walled tube structure. It includes a radial flange 142 adjacent and spaced from that end thereof which provides the nozzle inlet.

The tube 71' has a bore one end of which is counterbored to seat and nest the flange 142 when the nozzle is assembled to the adapter. As shown in side elevation in FIG. 5, the tube 71' is cut away and channeled at its underside from a point adjacent and spaced from that end thereof which receives the nozzle 78'' in a configuration to complimentarily nest an intermediate portion of the length of the tube 140 which includes its 90° curve. As the tube 140 is so nested and seated in the channel of the cut away portion at the underside of the tube 71', its eductor tube portion 76' will position in coaxial alignment with the bore of the tube 71', which is terminated by the cut away. At the same time the outer side of the 90° curve of the tube 140 has a single aperture therein which will also position in a coaxial alignment with the bore of the tube 71'.

In the application of the nozzle 78'' to the adapter, the leading end of the discharge end portion thereof will be advanced inwardly of the bore of the tube 71' by way of its counterbore to pass therethrough, through the aperture in the 90° curve of the tube 140 coaxial therewith and into the inlet end of the eductor tube portion 76'. As the flange 142 is fully seated to the shoulder defined by the counterbore, the discharge extremity of the nozzle will project into the inner end of the tube portion 76', in a coaxial closely spaced relation to its inner wall surface. It is noted that the nozzle will be so dimensioned as to have a press fit within the body of the tube 71'. This assembly will establish the short inlet end portion of the nozzle in a projected relation to one end of the tube 71'. Thus, as this eductor assembly is applied to the air delivery device 30, the inlet end of the nozzle 78'' will plug-fit in the outermost end of the insert 67' in the discharge end of the bore 33 in the barrel portion 32.

Where circumstances require, suitable adhesive will be applied to the parts of the eductor assembly, which are all made of plastic, to secure them in their assembled relation. Once the eductor assembly of FIG. 5 is applied to form in part an extension of the barrel portion 32, it is retained in place by the frictional engagement of the clip 80, the details of which have been previously set forth.

It will be clearly seen that the delivery of air under pressure through the nozzle 78'' will result in a high velocity projection of such air to and through the eductor portion 76'. In the course of its flow, there will be a pressure drop immediately about the discharge end of the nozzle producing a suction which is reflected back through the 90° curved portion of the tube 140 and the connected syphon tube portion 74' which is applied to the contents of any container in which the tube portion 74' may be immersed. The result is a smooth and free flowing withdrawal of the container contents by way of the syphon tube portion 74' and its curved extension which communicates with the eductor tube portion 76' by way of the annular passage about the discharge end of the nozzle 78''. The arrangement provides, even with relatively heavy viscous material, its relatively uniform discharge in a spray pattern in which the particles of the material are uniformly dispersed. The reasons why the embodiments of the invention have proven to produce an unexpected superior control of materials in their application to surfaces as a sprayed coating cannot be precisely defined. It nevertheless has been determined that the invention provides a means and method for more quickly and effectively applying a coating to the surface of an object in a most efficient and superior manner. Moreover, it has been proven in test that the invention embodiments provide highly versatile apparatus which may be used for dispensing materials of highly different viscosity without diminishing the quality of performance. The unique throw-away eductor and the means and method of its application enable a quick, simple and economical interchange of parts so apparatus for delivery of a gaseous fluid such as air under pressure may be readily converted to use for different applications of different materials.

It is preferred that the eductor assembly of the invention be made of polyethylene or polypropylene material. In the use of such plastic or the equivalent for this assembly not only is it made resistant to contamination, essentially except by pressure sensitive liquid adhesives, but it can then be used to spray corrosive, abrasive and catalyzed materials. The "throw-away" aspect of the eductor assembly of the invention is most important in this respect.

A very simple but important feature of preferred embodiments of the invention is the inclusion of a very inexpensive but highly effective strap-type support for the containers of the material to be dispensed.

From the above description it will be apparent that there is thus provided a device of the character described possessing the particular features of advantage before enumerated as desirable, but which obviously is susceptible of modification in its form, proportions, detail construction and arrangement of parts without departing from the principle involved or sacrificing any of its advantages.

While in order to comply with the statute the invention has been described in language more or less specific as to structural features, it is to be understood that the invention is not limited to the specific features shown, but that the means and construction herein disclosed comprise but one of several modes of putting the invention into effect and the invention is therefore claimed in any of its forms of modifications within the legitimate and valid scope of the appended claims.

The embodiments of the invention in which an exclusive property or privilege is claimed are defined as follows:

1. Apparatus capable of use to effectively dispense viscous material in a spray form comprising a plurality of tubular elements the interior wall surface of each of which defines a bore open to each of its opposite ends, one of said elements providing an eductor tube and another a nozzle tube, said elements being constructed of disposable non-metallic material and being configured to have a direct axial application and telescopic interfit of one thereof to another to provide a unitized tubular structure wherein said nozzle and said eductor tubes are in a substantially coaxial relation, an opening being defined in one of said tubular elements adapting said tubular structure for the coupling thereto of a syphon tube, or its equivalent, which may be applied to place material to be dispensed in open communication with the bore of said eductor tube, said nozzle tube being adapted to be applied to the discharge end of a device capable of delivering therethrough a pressured flow of gaseous fluid, the bore of said nozzle being formed to receive and produce therein a substantially uniform flow of such gaseous fluid and to provide a high velocity discharge thereof to and through said eductor tube to draw thereto the material to be dispensed and carry it therewith through the bore of said eductor tube, said eductor tube being configured to provide that the material drawn thereto is influenced thereby to uniformly disseminate in the gaseous fluid and in the discharge thereof be uniformly dispersed in a manner to facilitate a controlled deposit thereof on a surface, as and when required said tubular elements including a third tube which bridges said eductor and nozzle tubes, said opening being a substantial radial opening in the wall of said third tube, a further small bore syphon or like tube applied within and in telescopically coupled relation to said tubular structure to have one end thereof positioned in means forming a radial extension of said opening and to extend therefrom for the placement of the bore thereof in open communication with materials to be dispensed, in which the opposite end of the syphon or like tube is immersed, and said further small bore tube having a portion thereof extended to project within the bore of said eductor tube at the end thereof which constitutes its inlet end, said portion of said small bore tube positioning in a substantially concentric spaced relation to the inner wall surface of said eductor tube and providing thereby that the gaseous fluid discharged from said nozzle tube is directed to move in a high velocity flow in surrounding relation to that portion of said further small bore tube within said eductor tube to induce the flow therethrough and therefrom of the material with which it has been placed in communication, the construction and arrangement providing for a dissemination of such material in the flow of the gaseous fluid discharged from said eductor tube.

2. Apparatus capable of use to effectively dispense viscous material in a spray form comprising a plurality of tubular elements the interior wall surface of each of which defines a bore open to each of its opposite ends, one of said elements providing an eductor tube and another a nozzle tube, said elements being constructed of disposable non-metallic material and being configured to have a direct axial application and telescopic interfit of one thereof to another to provide a unitized tubular structure wherein said nozzle and said eductor tubes are in a substantially coaxial relation, an opening being defined in one of said tubular elements adapting said tubular structure for the coupling thereto of a syphon tube, or its equivalent, which may be applied to place material to be dispensed in open communication with the bore of said eductor tube, said nozzle tube being adapted to be applied to the discharge end of a device capable of delivering therethrough a pressured flow of gaseous fluid, the bore of said nozzle being formed to receive and produce therein a substantially uniform flow of such gaseous fluid and to provide a high velocity discharge thereof to and through said eductor tube to draw thereto the material to be dispensed and carry it therewith through the bore of said eductor tube, said eductor tube being configured to provide that the material drawn thereto is influenced thereby to uniformly disseminate in the gaseous fluid and in the discharge thereof be uniformly dispersed in a manner to facilitate a controlled deposit thereof on a surface, as and when required, a device adapted for the delivery therethrough of a gaseous fluid under pressure from a source of supply, said device having a passage defining a bore through which the gaseous fluid may be delivered under pressure, one end portion of said nozzle tube being constructed as to have a plug-type fit in means defining the discharge end of the bore of said device, thereby to provide for a telescopic interfit of said unitized structure to said device to extend the bore of said device and to make the unitized tubular structure readily interchangeable to fit the required application of said device, a clip-type connector releasably retaining said unitized tubular structure to said device through which gaseous fluid in delivered under pressure from a source of supply a suspension element releasably attached to a surface portion of said device adjacent its discharge end, a suspension element comprising an arm one end portion of which is connected to a surface portion of said device adjacent its discharge end to have the opposite end portion thereof in a dependent projected relation thereto, said opposite end portion being bifurcated to form therefrom a pair of fingers which are laterally spaced from their innermost end portions to their projected extremities, adjacent sides of said fingers being formed to have complementarily curved configurations, said fingers being relatively offset from their innermost to their outer ends to provide that the adjacent sides of said fingers are formed in a configuration corresponding to a section of a helix to which a container of material to be dispensed having a screw-type thread on a neck or body thereof which is complementary in shape to the curve of the helix may be screwed and thereby stably supported with reference to said device to which it is connected and in an appropriate attitude referenced to said unitized tubular structure which forms an extension of said bore of said device.

3. Apparatus as in claim 2 characterized in that said arm is provided by a strap-like element which is bent intermediate its ends to displace said bifurcated end portion to a level below said device as said device is positioned in use of the releasably applied unitized tubular structure.

4. Apparatus as in claim 2 characterized in that said fingers are arcuately configured to curve inwardly towards each other and in levels which are displaced whereby to provide that said fingers in their composite assume the form of a section of a helix and the projected extremities of said fingers are laterally spaced.

5. Apparatus capable of use to effectively dispense viscous material in a spray form comprising a plurality of tubular elements the interior wall surface of each of which defines a bore open to each of its opposite ends, one of said elements providing an eductor tube and another a nozzle tube, said elements being configured to have a direct axial application and telescopic interfit of one thereof to another to provide a unitized tubular structure wherein said nozzle and said eductor tubes are in a substantially coaxial relation, an opening being defined in one of said tubular elements adapting said tubular structure for the coupling thereto of a syphon tube, or its equivalent, which may be applied to place material to be dispensed in open communication with the bore of said eductor tube, said nozzle tube being adapted to be applied to the discharge end of a device capable of delivering therethrough a pressured flow of gaseous fluid, the bore of said nozzle being formed to receive and produce therein a substantially uniform flow of such gaseous fluid and to provide a high velocity discharge thereof to and through said eductor tube to draw thereto the material to be dispensed and carry it therewith through the bore of said eductor tube, said eductor tube being configured to provide that the material drawn thereto is influenced thereby to uniformly disseminate in the gaseous fluid and in the discharge thereof be uniformly dispersed in a manner to facilitate a controlled deposit thereof on a surface, as and when required, a device adapted for the delivery therethrough of a gaseous fluid under pressure from a source of supply, said device having a passage defining a bore through which the gaseous fluid may be delivered under pressure, one end portion of said nozzle tube being constructed as to have a plug-type fit in means defining the discharge end of the bore of said device, thereby to provide for a telescopic interfit of said unitized structure to said device to extend the bore of said device and to make the unitized tubular structure readily interchangeable to fit the required application of said device, the means defining the discharge end of the bore of said device being a tubular structure the discharge extremity of which has a notch therein intersecting the bore thereof, said tubular elements including a third tube bridging said eductor and nozzle tubes, said opening in said tubular structure being a radial opening in the wall of said third tube rimmed by a tubular projection to which one end of a syphon tube is fixed to form an extension of said opening and said tubular projection being nested in said notch as said unitized tubular structure telescopically fits in the discharge end of the said bore of said device.

6. Apparatus as in claim 5 characterized in that said tubular structure of said device has means attaching thereto to releasably and stably mount a container of the material to be dispensed by said unitized tubular structure which forms an extension of its bore, without fasteners, immediately thereof and of said unitized tubular structure, thereby to facilitate the direct dependency in the contents of the container of said syphon tube.

7. A support device for a container the contents of which are to be dispensed comprising an arm element one end portion of which is adapted to be connected to a base structure and the opposite end portion of which is bifurcated to form therefrom a pair of fingers which are laterally spaced from their innermost end portions to their projected extremities, adjacent sides of said fingers being formed to have complementarily curved configurations, said fingers being relatively offset as they extend from their innermost end portions to their projected extremities to form thereby a configuration corresponding to a section of a helix, by virtue of which a container having a screw type thread on the neck or the body thereof which is complementary in shape to the curve of the inner sides of said fingers may be screwed to said fingers and thereby stably engaged to said support device and correspondingly with reference to a base support to which it may be secured.

8. Apparatus as in claim 7 characterized in that said fingers are arcuately configured as a whole to curve inwardly towards each other at their projected extremities and their projected extremities are laterally spaced.

* * * * *

UNITED STATES PATENT AND TRADEMARK OFFICE

CERTIFICATE OF CORRECTION

PATENT NO. : 4,804,144

DATED : February 14, 1989

INVENTOR(S) : Stephen A. Denman

It is certified that error appears in the above-identified patent and that said Letters Patent is hereby corrected as shown below:

Col. 2, line 35, -- spraying viscous materials useful in coating procedures -- is inserted following "for".

Col. 9, line 32, "erlement" is corrected to read -- element --;

line 67, -- in -- is inserted following "container";

line 68, "in" is deleted.

Col. 11, line 5, "ends" is corrected to read -- end --.

Col. 12, line 63, -- assembly -- is inserted following "eductor";

Col. 14, line 63 (Claim 2, line 43), "in" is corrected to read -- is --.

Col. 15, line 35 (Claim 5, line 6) -- constructed of disposable non-metallic material and being -- is inserted following "being".

Signed and Sealed this

Twenty-third Day of January, 1990

*Attest:*

JEFFREY M. SAMUELS

*Attesting Officer* *Acting Commissioner of Patents and Trademarks*